US005272983A

United States Patent [19]

Sippel et al.

[11] Patent Number: 5,272,983

[45] Date of Patent: Dec. 28, 1993

[54] CASING BOTTOM FOR A PROPELLING CHARGE

[75] Inventors: Achim Sippel; Heinz-Josef Kruse, both of Ratingen; Gisbert Bartsch, Halle in Westfalen; Egon Gampe, Monheim; Wilfried Becker, Düsseldorf, all of Fed. Rep. of Germany

[73] Assignee: Rheinmetall GmbH, Ratingen, Fed. Rep. of Germany

[21] Appl. No.: 947,397

[22] Filed: Sep. 21, 1992

[30] Foreign Application Priority Data

Sep. 20, 1991 [DE] Fed. Rep. of Germany ..... 4131285

[51] Int. Cl.[5] ..... F42B 5/26

[52] U.S. Cl. ..... 102/469; 102/430; 102/464; 102/470

[58] Field of Search ..... 102/430, 464–470, 102/472, 433, 434; 42/25

[56] References Cited

U.S. PATENT DOCUMENTS

| | | | |
|---|---|---|---|
| 3,860 | 1/1870 | Hicks | 42/25 |
| 142,924 | 9/1873 | Logan et al. | 102/469 |
| 237,686 | 2/1881 | King | 102/470 |
| 322,730 | 7/1885 | Knight et al. | 102/470 |
| 387,723 | 8/1888 | Lorenz | 102/470 |
| 3,351,019 | 11/1967 | Schaadt et al. | 102/470 |
| 4,836,085 | 6/1989 | Winkler et al. | 89/45 |

*Primary Examiner*—Harold J. Tudor

[57] ABSTRACT

A casing bottom for a propelling charge including a circular ring shaped (annular) base plate (1) which accommodates a centrally arranged primer sleeve (7) in a form-locking manner. In order to be able to unload ammunition, particularly two-part ammunition including sub-caliber projectiles, the rear surface of the primer sleeve is provided with a recess for form-fittingly receiving an extractor. Preferably the recess is of a size which can be accommodated on a sub-caliber projectile.

6 Claims, 1 Drawing Sheet

CASING BOTTOM FOR A PROPELLING CHARGE

BACKGROUND OF THE INVENTION

The present invention relates to a casing bottom for a propelling charge. More particularly, the present invention relates to such a casing bottom which includes a base plate, in the form of a circular ring, which accommodates a centrally arranged primer sleeve in a form locking manner, preferably by way of a thread engagement.

Present-day tank ammunition is made of one piece. That is, such ammunition is composed of a propelling charge casing which is filled with a propelling charge and has a projectile body inserted therein. Both the casing and the projectile are loaded together. The propelling charge casing has a casing bottom that includes a base plate into which a sleeve or bushing can be screwed to accommodate a primer element. There is no way to unload the ammunition without first firing it.

As shown, for example, in DE-OS 3,701,713 corresponding to U.S. Pat. No. 4,836,085, present development is toward two-part ammunition, that is, ammunition in which the projectile body and the propelling charge are provided in separate magazines and are loaded separately. Such ammunition also includes sub-caliber ammunition, such as kinetic energy penetrators.

SUMMARY OF THE INVENTION

It is an object of the present invention to provide a casing bottom of the type discussed above which permits unloading of the ammunition by means of an extractor, even if the ammunition is composed of two parts and includes sub-caliber projectiles.

This object generally is achieved according to the present invention by a casing bottom for a propelling charge including a circular ring (annular) shaped base plate, a primer sleeve centrally disposed in the base plate, means for form-lockingly connecting the sleeve to the base plate, and a rotationally symmetrical, undercut, extractor receiving recess formed in the rear surface of the primer sleeve and being open in a rearward direction of the casing bottom.

Preferably the recess is of a size suitable for an extractor receiving recess of a sub-caliber projectile so that the same extractor may be used for all ammunition parts for a weapon.

Further features of the invention will be found in the following detailed description of the invention with reference to embodiments thereof illustrated in the attached drawings.

DETAILED DESCRIPTION OF THE PREFERRED EMBODIMENTS

Figure 1:
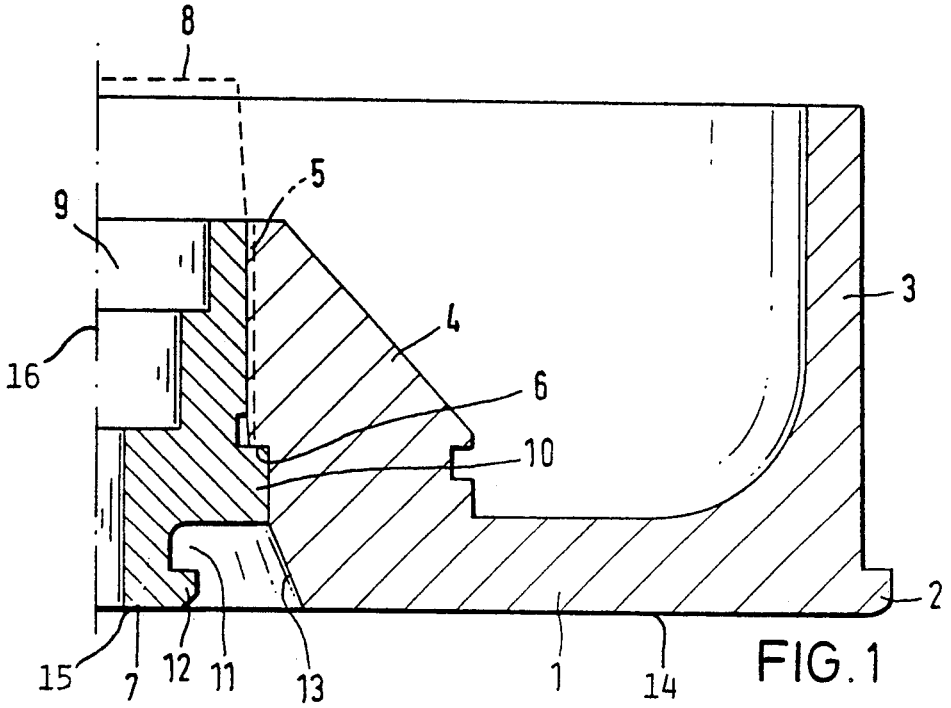
FIG. 1 is a sectional view of one-half of an embodiment of a casing bottom according to the invention.

The casing bottom, or stub casing, shown in FIG. 1 includes an annular, i.e. circular ring shaped, base plate 1 which on its outer circumference ends in a collar 2 and is formed in one piece with a cylindrical casing section 3. The rotationally symmetrical casing bottom further includes a sleeve section 4, which is likewise formed in one piece with the base plate 1, which extends centrally and axially as well as inwardly from the base plate 1, and which is provided with an internal thread on an inner portion 5. Toward the rear of the casing bottom, portion 5 is delimited by a radially extending circumferential contact shoulder 6.

A primer sleeve or bushing 7, for accommodating a propelling charge primer 8, is screwed into sleeve section 4 via an external thread, which is disposed on at least a portion of the circumferential surface of sleeve 7 and which matingly engages the internal thread of the sleeve portion 5 to produce a form-locking connection. Primer sleeve 7 is provided with a central, axially extending bore 9 that becomes wider in steps toward the interior so as to accommodate the propelling charge primer 8 and, on its outer circumference, with a collar 10 that is axially inwardly offset relative to the rear face or surface 14 of the casing bottom. When primer sleeve 7 is screwed into sleeve 4, this collar 10 comes into engagement with the contact shoulder 6 to properly position the primer sleeve 7 in the base plate 1.

The rear end surface 15 of the primer sleeve 7 is provided with a rearwardly open, rotationally symmetrical recess 11 which undercuts the surface 15 in the direction toward the longitudinal axis 16 of the casing bottom so as to form a collar 12. The recess 11 (hereinafter called the extractor receiving recess) has a size and shape to receive an extractor in a form-fitting manner for the purpose of unloading the propelling charge (or, if one-piece ammunition is involved, the entire ammunition unit) by engaging the undercut collar 12.

In the illustrated embodiment, the recess 11 is formed at an outer edge of the rear end surface 15 of sleeve 7 and consequently would likewise be open radially in an outward direction. However, with the sleeve 7 secured in the base plate 1, the recess 11 is delimited in the outer radial direction by an end surface portion 13 of the base plate 1 so that the recess 11 is effectively open only in the rearward direction.

Preferably the extractor receiving recess 11 in the casing bottom has a size which essentially corresponds to an extractor recess for a sub-caliber projectile. In such a projectile, a form locking zone can be formed only over a correspondingly small partial circle diameter, because of the ammunition diameter itself, which lies in a range between about 25 and 30 mm. Consequently, in order to be able to unload all types of projectiles, including those of normal caliber, and the propelling charges, all ammunition components preferably are provided with an extractor zone corresponding to an extractor receiving recess 11 suitable for a subcaliber projectile as described above, and can thus all be unloaded with one and the same extractor. This permits a favorable configuration for the ramming head of a loading and unloading device.

To permit easy engagement of the extractor, the edge surface portion 13 of the bottom plate 1 adjacent to the extractor receiving recess 11 is provided with a slope as shown.

Figure 2:
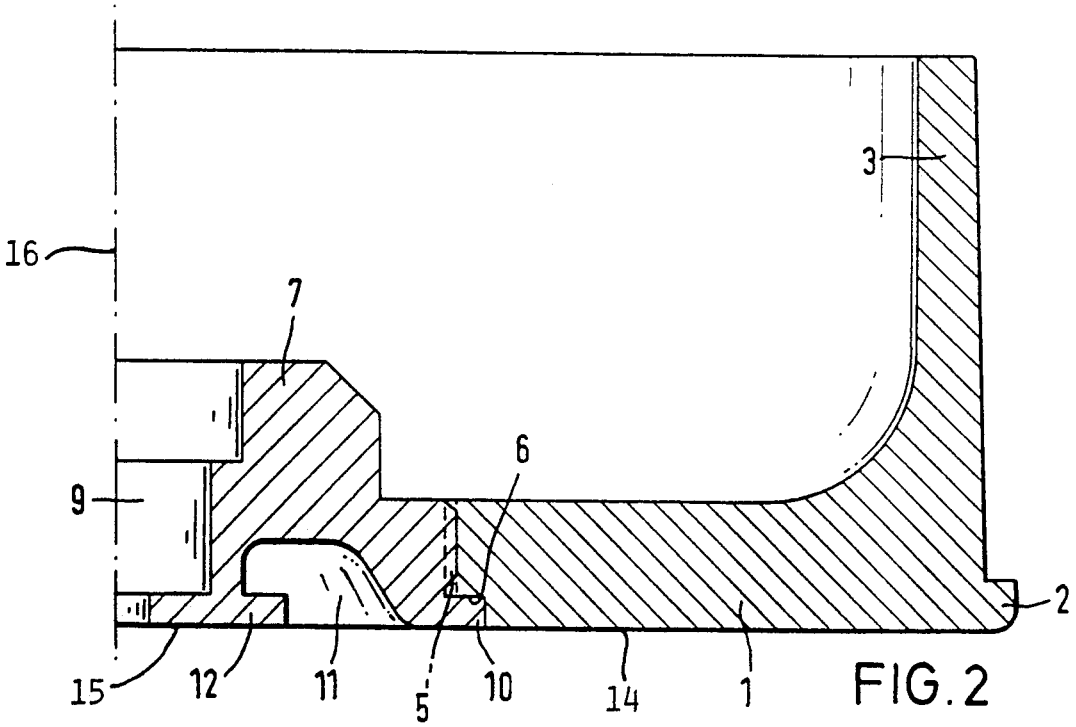
FIG. 2 is a sectional view of one-half of another embodiment of a casing bottom according to the invention.

In the embodiment of FIG. 2, wherein like parts are given the same reference numeral, the rearwardly open extractor receiver recess 11 is configured so that it is entirely within the primer sleeve 7, i.e. recess 11 is not delimited on its circumference by the wall portion 13 of bottom plate 1 as in the embodiment of FIG. 1. Additionally, the collar 10 is not offset inwardly from the rearward surface of the casing bottom, but rather is configured to be flush with the rear surface 14 of the casing bottom.

Although not shown, extractor receiving recess 11 may also be configured so as to undercut the rear end surface 15 of the sleeve 7 in a direction toward the outer circumference of the casing bottom so that the collar 12 formed thereby is oriented inwardly rather than outwardly as in FIG. 1.

Due to the fact that the extractor receiving recess 11 is formed in the primer sleeve 7, the region of the casing bottom which is critical from a strength stand point can be accommodated separately and corresponding to the firing stresses involved, so that economical manufacturing methods can be employed for the simply constructed casing bottom.

The invention now being fully described, it will be apparent to one of ordinary skill in the art that any changes and modifications can be made thereto without departing from the spirit or scope of the invention as set forth herein.

What is claimed is:

1. A casing bottom for a propelling charge, which casing bottom includes:

a base plate in the form of a circular ring;

a primer sleeve centrally disposed in said base plate;

means for form-lockingly connecting said sleeve to said base plate comprising mating threads on said sleeve and on said base plate and including a radially extending contact shoulder on an inner edge surface of said base plate and a radially extending collar disposed on an outer circumferential surface of said primer sleeve and engaging said shoulder; and a rotationally symmetrical, undercut, extractor receiving recess formed in a rear surface of said primer sleeve and being open in a rearward direction of said casing bottom.

2. A casing bottom as defined in claim 1, wherein said rear surface of said primer sleeve is undercut in a radially inward direction.

3. A casing bottom as defined in claim 1, further including an axially and inwardly directed sleeve section formed in one piece with said base plate receiving said primer sleeve to provide a form-locking connection.

4. A casing bottom as defined in claim 3, wherein: said recess in said primer sleeve is normally additionally open outwardly in a radial direction, and said recess is delimited at its said open radial direction by an inner edge surface portion of said base plate.

5. A casing bottom as defined in claim 1, wherein said recess opens only in said rearward direction.

6. A casing bottom as defined in claim 1, wherein said collar on said printer sleeve is offset axially inwardly relative to a rear surface of said casing bottom.

* * * * *